United States Patent [19]

Ogden et al.

[11] Patent Number: 4,813,563

[45] Date of Patent: Mar. 21, 1989

[54] TAMPER RESISTANT, TAMPER EVIDENT LEAK PROOF CONTAINER

[75] Inventors: Stanley D. Ogden, Clovis; William C. Dixon, Fresno, both of Calif.

[73] Assignee: Doxtech, Inc., Fresno, Calif.

[21] Appl. No.: 43,904

[22] Filed: Apr. 27, 1987

[51] Int. Cl.[4] ..... B65D 39/00

[52] U.S. Cl. ..... 215/253; 215/355; 215/366; 220/266

[58] Field of Search ..... 215/355, 365, 230, 253, 215/366; 220/266, 276

[56] References Cited

U.S. PATENT DOCUMENTS

| | | | |
|---|---|---|---|
| 3,348,719 | 10/1967 | Rausing et al. | 215/253 |
| 3,374,911 | 3/1968 | White | 215/366 |
| 3,567,061 | 3/1971 | Song | 220/266 X |
| 3,898,046 | 8/1975 | Ikeda et al. | 215/355 X |
| 4,098,422 | 7/1978 | Slomski | 215/355 |
| 4,231,486 | 11/1980 | Bock | 215/355 X |
| 4,399,920 | 8/1983 | Swartzbaugh et al. | 215/211 |
| 4,452,364 | 6/1984 | Kay | 215/253 |
| 4,461,391 | 7/1984 | Davis | 215/252 |
| 4,534,480 | 8/1985 | Santostasi et al. | 215/252 |
| 4,541,536 | 9/1985 | Davis et al. | 215/252 |
| 4,548,329 | 10/1985 | Curry | 215/252 X |
| 4,588,100 | 5/1986 | Itsubo et al. | 215/252 X |
| 4,592,475 | 6/1986 | Hannon et al. | 215/252 |
| 4,592,476 | 6/1986 | Yasada | 215/252 |
| 4,597,500 | 7/1986 | Stubbs | 215/256 |
| 4,609,115 | 9/1986 | Moore et al. | 215/252 |
| 4,630,743 | 12/1986 | Wright | 215/253 X |

FOREIGN PATENT DOCUMENTS

| | | | |
|---|---|---|---|
| 1007350 | 2/1952 | France | 215/355 |
| 1131300 | 10/1956 | France | 215/355 |

*Primary Examiner*—Donald F. Norton

*Attorney, Agent, or Firm*—Flehr, Hohbach, Test, Albritton & Herbert

[57] ABSTRACT

A tamper resistant, tamper evident container is formed of a vial having a barb or hook formed inside the open upper end, a cap adapted for insertion into the vial having a mating hook formed about the lower edge, and sealing rings formed on the outer surface thereof for providing tamper-resistant, leak-proof sealing between the enclosure and the vial. The enclosure or cap also includes a spout which may extend inwardly into the enclosure or outwardly, away from the enclosure. In a preferred embodiment, the spout has an integral seal member defined at the top or bottom thereof by a circumferential line of reduced thickness for facilitating separation of the seal member from the spout. Preferably, a liquid-proof identification label is used which is placed inside the vial prior to closure. This label may include temperature sensitive indicia which change colors at selected temperatures, for example, above and below the normal body temperature, for providing additional proof of non-tampered, strictly human-origin contents.

25 Claims, 2 Drawing Sheets

MAXIMUM FILL
90ML
60ML
30ML
3OZ.
2OZ.
1OZ.
NAME
I.D.NO.
DATE
AGENT 12
60
56
32
58
57
55
59
13
48
45
47
46

TAMPER RESISTANT, TAMPER EVIDENT LEAK PROOF CONTAINER

BACKGROUND OF THE INVENTION

The present invention relates generally to the field of tamper resistant containers for storing and transporting liquids and solids, such as urine specimens and tablets. In particular, the present invention itself relates to a tamper resistant, tamper evident container for liquids and solids and to such a container which provides a secure chain of custody.

The need for, and problems in, providing tamper proof contains for solids such as aspirin, prescription drugs and other pharmaceuticals and for tamper proof chain of custody containers for liquids such as urine samples are well known. Considering, first, pharmaceutical containers, one widely used type of protection against tampering or adulteration of the container contents involves affixing a metal or plastic seal over the mouth of the container, beneath the screw cap. While such seals can be removed or destroyed, in theory the removal or destruction would result in visible damage to the seal, which would warn the user of the possibility of tampering. However, in reality, it may be possible to remove the seal intact, for example, by degrading the adhesive but not the seal, with the result that the seal can be replaced without leaving evidence of the tampering. Also, it may be relatively easy to obtain or fashion a replacement seal. In short, the widely used tamper-evident seals may be circumvented.

Secondly, change of custody liquid containers typically consist of a sealable bag having an external identification label or a bottle or vial which has a screw cap and an external identification label. Physical security against tampering may be provided in several ways such as by ratchet-type lids. Evidence of tampering may be provided by an adhesive tape which is adhered over the cap and vial. However, it may be possible to remove the tape intact by degrading the adhesive. Also, it may still be possible to fashion or obtain a replacement tape to replace the one removed. Furthermore, the identification label is susceptible to being removed and/or altered. As a consequence, it may be possible to simply alter the identifying indicia associated with a particular container or to interchange containers.

In short, conventional so-called tamper resistant containers suffer from disadvantages which include possible undetected removal of the "tamper-evident" seals, tampering of identification, and lack of certainty as to when the seal was actually supplied, and the lack of true physical security against tampering. In addition, providing leak proof containers and, in particular, the combination of resistance to tampering and resistance to leakage, is a very difficult task.

SUMMARY OF THE INVENTION

In view of the above discussion, it is one object of the present invention to provide a container which is highly tamper resistant, highly tamper evident and leak proof.

In one aspect, the tamper resistant, tamper evident container of our invention comprises a generally cylindrical open top vial or cup having inwardly extending barb means formed about the upper inner surface thereof; and a cover or enclosure of size and configuration for insertion into the open end of the vial and comprising an open bottom cylinder having outwardly extending hook means formed about the bottom outer surface thereof, the cylinder having an integral enclosed region defining a potential opening.

Preferably, the container includes a liquid-resistant identification label of size and configuration for being placed inside the cup.

In another aspect, the tamper resistant, tamper evident container of our invention comprises a generally cylindrical flexible open top vial or cup having inwardly extending barb means formed about the upper inner surface thereof; a cover or enclosure of size and configuration for insertion into the open end of the vial and comprising an open bottom cylinder having outwardly extending hook means formed about the bottom outer surface thereof, the cylinder having an integral enclosed region defining a potential opening; and a flexible annulus joined integrally to and spaced laterally outwardly from the open bottom cylinder and having peripheral ribs formed in the outer surface thereof of size for sealing against the inside of the cup.

BRIEF DESCRIPTION OF THE DRAWINGS

The above and other aspects of our present invention are described in the drawings in which.

DETAILED DESCRIPTION

Figures 1, 2, 3:
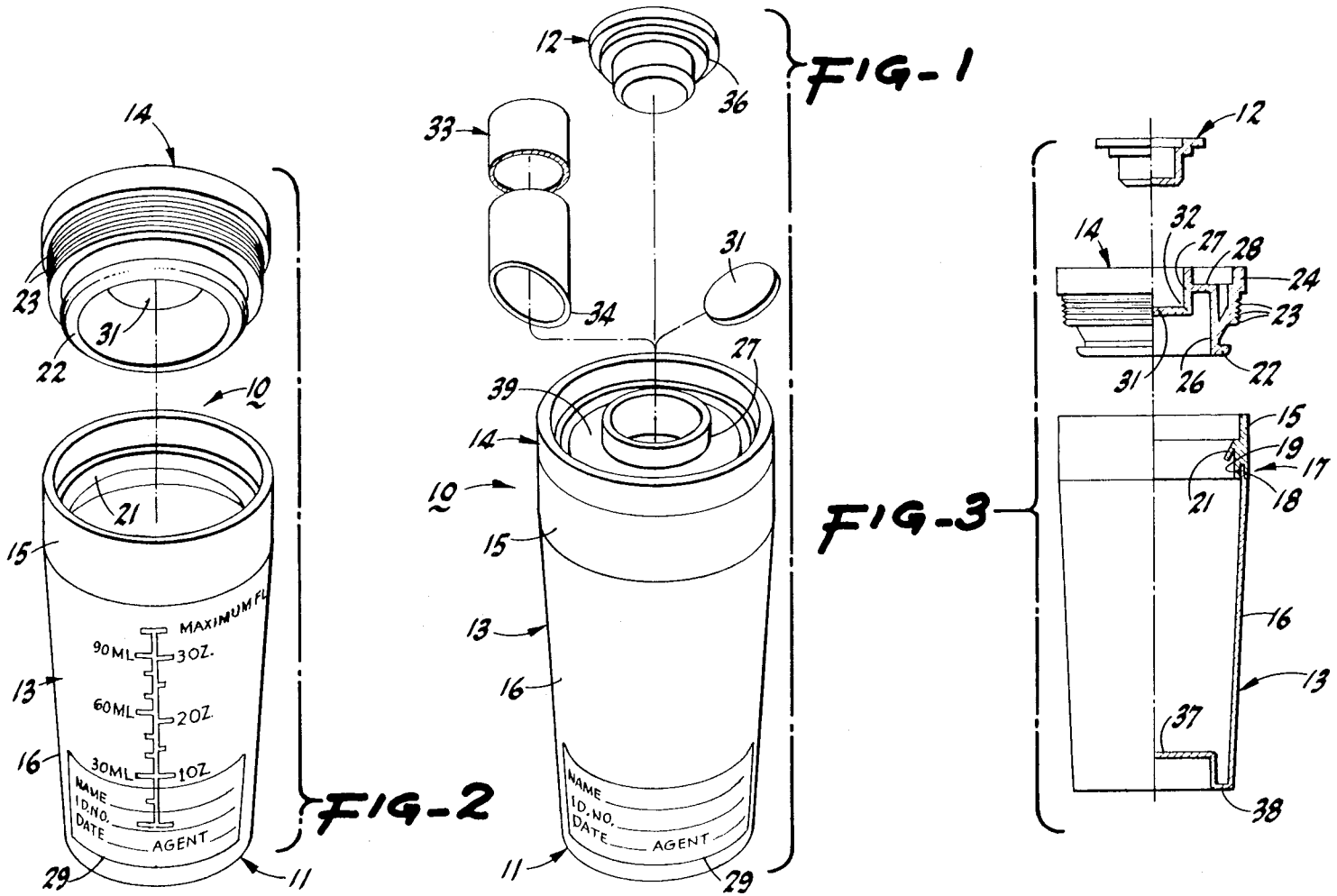
FIG. 1 is a perspective view of a presently preferred embodiment of our tamper resistant, tamper evident, leak proof container showing the relationship of the bottle, removable seal tab, seal tab removal tool, and plug.
FIG. 2 is an exploded perspective view of the bottle portion of the container of FIG. 1, showing the relationship of the locking cover or closure to the cup.
FIG. 3 is an exploded elevation view, partly in section, of the tamper proof container of FIG. 1.

A presently preferred embodiment of our tamper resistant, tamper evident container assembly 10 is shown in FIGS. 1–3. The locked, assembled container 10 comprises a cup or vial 13 and a locking closure 14. In turn, the cup or vial 13 comprises lower bowl or cup 16 and locking ring 15. Inside of the cup or vial 13 is a pre-marked identification label 29. The streamlined, hard container makes it difficult to grasp for tampering.

Referring further to FIGS. 1–3, typically, and as described further below, the above-described components can be injection molded from clear plastic. For example, the bottom bowl 16 and locking ring 15 can be injection molded from transparent, colorless medium viscosity injection molding resin such as Lexan 141 TM polycarbonate or equivalent. Lexan 141 TM is available from General Electric Company, Pittsfield, Me., U.S.A. Similarly, the locking closure 14 may be formed from heat stabilized medical application-type high density polypropylene homopolymer which is natural in color (no color). These materials do not have "memory" so that, if punctured by a hypodermic needle or other sharp instrument, the resulting hole is visually evident and leaks. In addition, these materials are relatively hard and are configured in a straight smooth profile to resist tampering. Nonetheless, these materials are sufficiently flexible to provide the enclosure sealing functions described at greater length below. If the materials were harder, they might simply preclude puncture rather than providing evidence of puncture, but would prevent puncture at the expense of possible loss of the liquid sealing function.

The container assembly 10, which is described above and at greater length below, is characterized by at least the following advantageous features: (1) ease of use and storage; (2) time security (i.e., assurance that the proper contents of the container were deposited at the proper time; and (3) tamper resistance; as well as (4) tamper evidence. Once the container 10 is used and the contents are deposited or inserted, and the enclosure inserted to seal the container, it is virtually impossible to tamper with or alter or replace the contents or the identification label inside the container without destroying the sealed container and/or leaving evidence of the attempt.

Referring further to FIGS. 1–3, to facilitate the injection molding process, the bottom bowl 16 and the ring 15 of the cylindrical vial or cup 13 are formed separately and then joined. As shown in particular in FIG. 3, this joint 17 comprises a mating tongue 18 and groove 19 formed in the top and bottom edges of the bottom bowl 16 and ring 15 (or vice versa). The container assembly 10 is permanently joined along the joint 17 by ultrasonic bonding or solvent welding, etc. In one present commercial embodiment, methylene chloride is applied to form a solvent-welded joint between the tongue 18 and groove 19, which as mentioned are formed of thermal plastic material such as polycarbonate or butadiene-styrene.

In use, the label 29 is filled out and placed inside the vial or cup assembly 13, the urine sample or other liquid, tablets, etc., are put into the vial or cup assembly 13, then closure 14 is inserted into the cup and is retained by two sealing joints. The first joint is formed by an interference-fit between circular barb 21 formed along the inner periphery of the cup's locking ring 15 and a mating circular hook 22 formed along the outer periphery of the bottom edge of the closure 14. The purposes of this joint are two-fold: primarily, to securely lock the inserted closure 14 to the vial 13, since the shape of the two parts allows a sliding fit in the direction of insertion only, while the interference between them prevents separation or removal except by damaging the container; and, secondarily, to provide a fluid/liquid seal. The second joint is provided by resilient sealing ribs 23—23, illustratively four in number, which are formed in the outer periphery of the closure 14 intermediate the top and bottom ends thereof. The functions of the rings 23—23 are, primarily, sealing and preventing fluid/liquid leakage betwen the vial 13 and the closure 14 and, second, aiding the joining function of the ratchet-type hook and barb joint 18—19.

Construction of the closure 14 is perhaps best shown in FIG. 3. Preferably, the rings 23'23 are formed in an annulus 24 which is formed integrally with inner annulus 26 and is spaced laterally outwardly from the inner annulus 26 by a joining web 30. The lower, inner annulus 26 incorporates circular hook 22 at the lower edge thereof. A cylindrical recessed spout 27 is connected by web 28 to the top edge of the annulus 26. Preferably, as mentioned previously, the closure 14 is formed of a hard relatively rigid yet slightly resilient, non-memory plastic material such as high density polypropylene. As a consequence of the use of this material, and of the sealing ribs 23—23 and the hook 22 being formed in the laterally off-set annuli 24 and 26, the annulus 26 and hook 22 deflect slightly during insertion of the closure 14 into the vial 13, allowing the hook 22 to thereby pass over the barb 21, and then lock under the barb 21. Also, the annulus 24 and sealing ribs 23—23 are deflected inwardly slightly during insertion and then spring back to securely compress the sealing ribs 23—23 against the inner surface of the locking ring 15 and provide the liquid-tight seal. The laterally offset relatively flexible rings or annuli 24 and 26 permit independent locking and sealing operation without one adversely affecting the other.

Access is gained to the interior of the bottle 11 for analysis or other use of the contents via a removable circular sealing tab 31 which is formed at the bottom of spout 27. Referring primarily to FIG. 3, the tab 31 is defined by a circular parting line 32 of reduced thickness which is formed between the tab 31 and the vertical wall of the spout 27, that is, at the edge between the tab 31 and cylindrical wall spout 27.

Referring to FIG. 2, the seal 31 is removed using any pointed knife or sharp instrument or a special cutting tool 33 which has an angled cutting end 34. Preferably, the cutting end 34 corresponds in both size and configuration to the parting line 32. In use, the tool 33 is inserted into a spout 27, cutting end first, and is rotated and pushed against the seal 31 to separate the seal from the spout 21 along the parting line 32. The vial contents or a sample of the contents can then be poured from the spout, removed by pipette, etc., for analysis or use. After removal of the contents, the container is resealed by inserting a mating, friction fit plug 12 into the spout 27. As shown in FIG. 1, the plug 12 has an upper flange 36 which both facilitates sealing against the spout 27 and also facilitates gripping and removal of the plug.

Referring again to FIGS. 1 and 3, the lower bowl/cup 16 has a recessed bottom 37 which is surrounded by a downwardly extending, generally circular, peripheral lip 38. The lip is sized to permit insertion into the recess 39, FIG. 1, in the top of the closure 14 of other containers and to provide a close fit against the circular lip or annulus 24, with the recess 37 clearing the top of the spout 27 and plug 12. This configuration permits stacking two or more containers, one on the other, for storage.

Figures 4, 5, 6, 7:
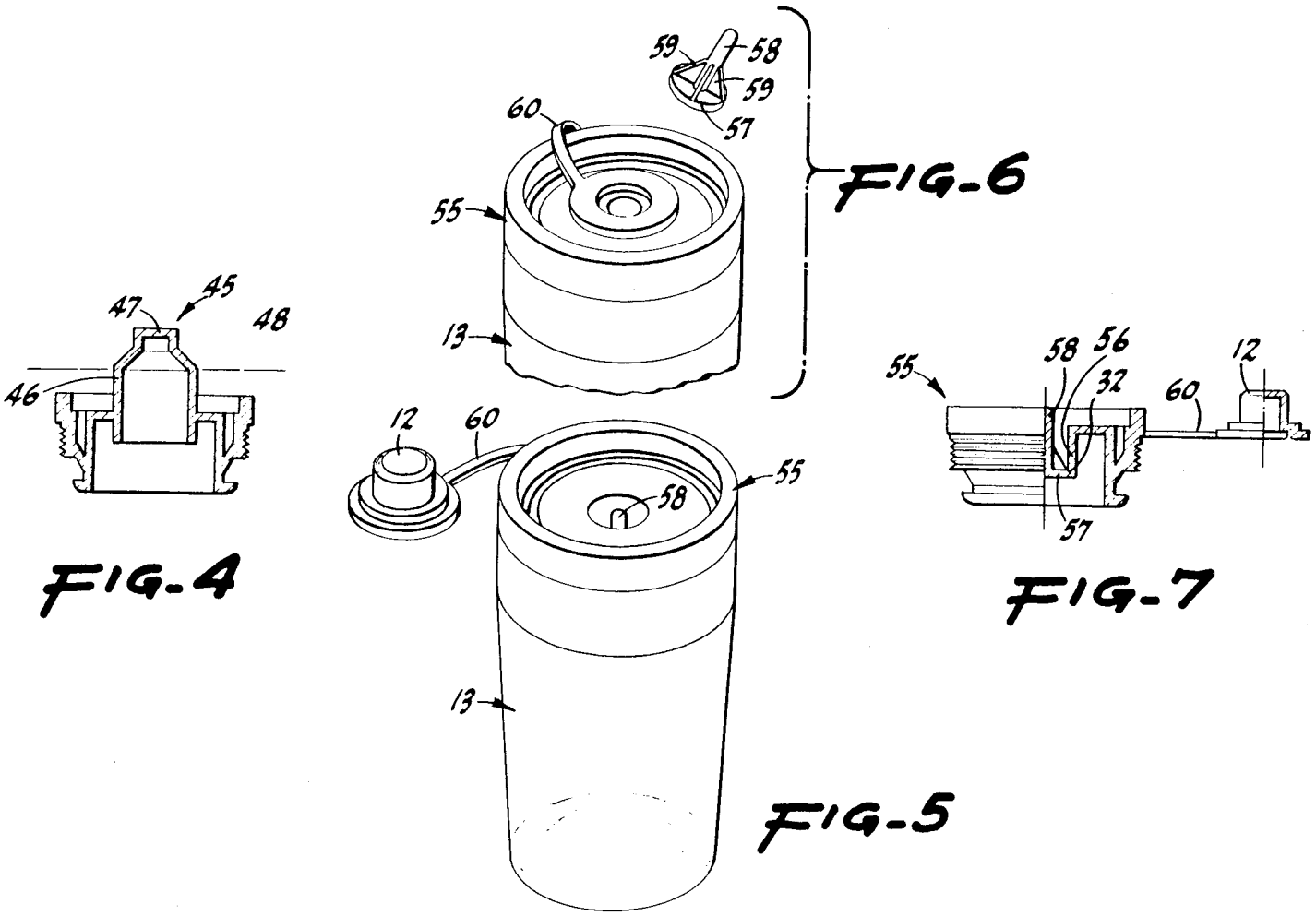
FIG. 4 is a cross-section of an alternative spool-type cup closure or cover.
FIGS. 5 and 6 are perspective views and FIG. 7 is a vertical cross-section of an alternative embodiment of the closure or cover which is depicted in FIGS. 1–4.

FIG. 4 depicts one example of an alternative closure 45 that has an upwardly extending spout 46 which extends above the plane of the closure 14 to facilitate pouring and access to the contents of the container. An integral top seal 47 can be cut away, for example, along line 48 using a sharp instrument. Alternatively, a parting line may be provided around the circumference of the spout 46 or in the seal 47 (similar to the parting line used in the seal 32 in the recessed spout 27, FIG. 1) to facilitate removal of the seal 47. It should be noted that both the seal 31, FIG. 1, and the seal 47, FIG. 4, are easily removed with tools or cutting instruments but have sufficient integrity to otherwise provide a permanent, leak-proof, tamper-resistant, tamper-evident structure.

FIGS. 5 through 7 depict another alternative enclosure 55 which incorporates a recessed spout 56 having a break-away seal 57. Like seal 31, FIG. 1, seal 57 preferably has a parting line 32 to facilitate removal. A rod 58 is integrally formed to the seal and supported by a number of integral ribs 59—59. The rod 58 is twisted back and forth a few times to break the seal along the parting line 32 so that the seal assembly can be removed. As shown in FIGS. 5 and 6, plug 12 can be attached or formed integrally with a strap 60 which, in turn, is attached or formed integrally with the closure 55. Quite obviously, this prevents losing or misplacing the plug 12 and also facilitates use of the plug.

Summary of Use of the Container 10

To illustrate the use of the container 10 for the storage, transport and analysis of a liquid specimen such as urine, initially at a providing site (such as a doctor's office or lab) an attendant (such as a nurse or doctor) fills out the identification label 29 which identifies the individual who provides the sample, the date, recipient, etc., and inserts the label into the bottom vial 13. Preferably, the identification label is impervious to liquid. Also, the label may contain a unique sequential serial number and/or a bar code for reading by optical scanning instruments and automatic computer data input. The patient or subject then fills the vial 13 with urine, the closure 14 is inserted into the vial 13 and locked and sealed, and the resulting locked, sealed container assembly 10 may be transported or transferred to a lab for analysis.

The bottle 10 arrives at the lab intact, with the specimen and the identification label intact: the hard, smoothly profiled, locked, bottle 10 is essentially impregnable so that the integrity of the bottle 10 and the seal 31 are relatively immune to destruction or tampering and, thus, the contents of the container assembly including the specimen and label are also safe from tampering. In addition, any breaching of the container would leave detectable, physical evidence. Furthermore, as discussed above, the container material is designed to facilitate use and locking of the container and at the same time to leave physical evidence in the form of a hole if a needle or other sharp objects are inserted through the container. Thus, the lab or other recipient is assured by the lack of evidence of physical tampering that no tampering has taken place, that the identification information such as the name and the time on the label 29 have not been altered since sealing and, of course, that the specimen itself has not been tampered with.

In addition, temperature sensitive indicia such as temperature recording labels available from Wahl Instruments, Inc., Culver City, Calif., can be incorporated onto the label to monitor that the temperature, for example to ensure, the temperature of the as-deposited sample is within the normal human body temperature range. For example, two dots of such material which permanently therefore change colors at different temperatures such as 90° and 105° F., ensure that the deposited sample is neither too cold (in which case, the sample may have come directly from the subject or been diluted with tap water, etc.) nor too hot (the liquid was heated).

At the lab, a lab technician removes the seal tab 31, draws out the sample using a pipette or simply by pouring, for testing, then seals the container with the plug 12. Depending upon the results of the analysis or other criteria, the container is discarded or stored. If storage is required for lengthy periods, for example for preservation during legal proceedings, the container can be stacked and refrigerated or frozen without damage to the container.

Alternatively, where a liquid sealing capability is unnecessary, for example, where the container is used for a solid material such as tablets or granular materials, the rib seals 23—23 may be omitted. The materials such as aspirin or prescription tablets can be inserted into the vial or cup 13 at the point of manufacture or prescription and the closure 15 affixed at that time. Then, when the container is received by the consumer or end user, that person is ensured that the vial and contents have not been tampered by the fact that a bottle that is intact and the seal 31 unbroken. In this case, the customer or end user removes the seal 31 and replaces the seal with the plug 12.

In short, our container is characterized by a unique combination of highly tamper resistant construction and high visibility tamper evident construction.

Having thus described a preferred and alternative embodiments, what is claimed is:

1. A tamper resistant, tamper evident container, comprising:

a generally cylindrical cup having an open upper end, said cup being formed of hard, rigid material and having inwardly extending barb means formed about the upper inner surface thereof;

a cover of size and configuration for insertion into the open end of the cup, said cover comprising relatively flexible cylindrical wall means having outwardly extending hook means formed about the outer surface thereof;

the flexibility of said wall means permitting insertion of the hook means into said cup to engage said barb means and in combination with the rigidity of said cup and barb means providing secure locking engagement of said barb means with said hook means; and further comprising a liquid resistant identification label of size and configuration for being placed inside the cup.

2. A tamper resistant, tamper evident container, comprising:

a generally cylindrical cup having an open upper end, said cup being formed of hard, rigid material and having inwardly extending barb means formed about the upper inner surface thereof;

a cover of size and configuration for insertion into the open end of the cup, said cover comprising relatively flexible cylindrical wall means having outwardly extending hook means formed about the outer surface thereof;

the flexibility of said wall means permitting insertion of the hook means into said cup to engage said barb means and in combination with the rigidity of said cup and barb means providing secure locking engagement of said barb means with said hook means; and further comprising a liquid resistant identification label of size and configuration for being placed inside the cup, said label having temperature sensitive indicia adapted for permanently changing color at selected temperatures.

3. A tamper resistant, tamper evident container, comprising:

a generally cylindrical cup having an open upper end, and having inwardly extending barb means formed about the upper inner surface thereof;

a cover of size and configuration for insertion into the open end of the cup and comprising cylindrical wall means having outwardly extending hook means formed about the outer surface thereof for engaging said barb means upon insertion of said cover into said cup; and a flexible annulus joined integrally to and extending laterally outwardly from the bottom of said cylindrical wall means and having ribbed sealing means formed in the outer surface thereof of size for sealing against the inside of the cup.

4. The container of claim 1 or 2, further comprising a cylindrical spout formed in said cover and a seal member formed integrally with and spanning said spout, thereby closing said spout, said seal member having a surface section thereof bounded by a parting line of reduced thickness relative to the thickness of said seal member, for permitting removal of said section to form an opening in said spout.

5. The tamper resistant, tamper evident container of claim 4, further comprising a plug of size and configuration for removable insertion into said spout.

6. The container of claim 4, said spout extending outwardly from said cover.

7. The container of claim 4, said spout extending inwardly from said cover.

8. The tamper resistant, tamper evident container of claim 1, 2 or 3, further comprising a spout formed in said cover and a seal spanning and joined to said spout, thereby closing said spout.

9. The tamper resistant, tamper evident container of claim 3 or 8, further comprising a liquid impervious identification label of size and configuration for being placed inside the cup.

10. The tamper resistant, tamper evident container of claim 9, said label having temperature sensitive indicia adapted for permanently changing color at selected temperatures.

11. The tamper resistant, tamper evident container of claim 9 comprising at least two temperature sensitive indicia adapted for permanently changing color at respective temperatures below and above a selected temperature range of interest.

12. The container of claim 8, wherein said spout extends inwardly into said cup from said cover.

13. The container of claim 8, wherein said spout extends outwardly from said cover, away from said cup.

14. A tamper resistant, tamper evident container, comprising:

a generally cylindrical open top cup having inwardly extending barb means formed about the upper inner surface thereof;

a cover of size and configuration for insertion into the open end of the vial and comprising an open bottom cylindrical wall having outwardly extending hook means formed about the bottom outer surface thereof, the top surface of the cylindrical wall having an outwardly extending initially closed spout formed therein, the spout having an integral seal member thereacross closing said spout, said sealing member being joined to said spout by a reduced thickness region permitting removal of said sealing member to open said spout; and a flexible annulus joined integrally to and spaced laterally outwardly from the bottom of said cylindrical wall means and having ribbed sealing means formed in the outer surface thereof of size for sealing against the inside of the cup.

15. The tamper resistant, tamper evident container of claim 14, further comprising a plug of size and configuration adapted for insertion into said spout.

16. The tamper resistant, tamper evident container of claim 14, further comprising an outwardly extending gripping rod attached integrally to the seal member for facilitating separation of the seal member from the spout.

17. The tamper resistant, tamper evident container of claim 14, wherein the cup comprises an upper section containing the barb means and a lower storage section joined to the upper section.

18. The tamper resistant, tamper evident container of claim 14, wherein the cup comprises an upper section containing the barb means and a lower storage section joined to the upper section, the lower section being formed within an inwardly extending bottom depression defining a peripheral lip at the bottom edge thereof having a smaller outside diameter than the inside diameter of a corresponding upwardly extending lip on the cover, for stacking containers one on top of the other.

19. The tamper resistant, tamper evident container of claim 14, the cup being formed from hard, relatively inflexible plastic material and the cover being formed from hard, relatively flexible material for permitting insertion of the cover into the cup and providing secure joinder of said barb means and hook means and for providing resistance to destruction.

20. The tamper resistant, tamper evident container of claim 19, at least selected components of the container being formed of non-memory material such that a hole remains when the material is punctured by a sharp object such as a needle.

21. The tamper resistant, tamper evident container of claim 14, further comprising a liquid impervious identification label of size and configuration for being placed inside the cup.

22. The tamper resistant, tamper evident container of claim 21, said label having temperature sensitive indicia adapted for permanently changing color at selected temperatures.

23. The tamper resistant, tamper evident container of claim 21 comprising at least two temperature sensitive indicia adapted for permanently changing colors at respective temperatures below and above a selected temperature range of interest.

24. A tamper resistant, tamper evident container, comprising:

a cup having an open upper end, said cup being formed of hard rigid material and having inwardly extending first lip means formed about the upper inner surface thereof; and a cover formed of hard material, said cover being of size and configuration for sliding insertion into the open end of the cup and having outwardly extending second lip means formed about the outer surface thereof, said second lip means being of size and configuration selected for locking engagement with the first lip means;

a flexible annulus joined integrally to and spaced laterally outwardly from the bottom of said cover and having ribbed sealing means formed in the outer surface thereof of size for sealing against the inside of the cup; and the size and configuration of said second lip means and the relative flexibility of said cover permitting insertion of said second lip means into said cup to engage with said first lip means and in combination with the relative rigidity of said cup and first lip means providing secure locking engagement of said first lip means with said second lip means.

25. A tamper resistant, tamper evident container, comprising:

a generally cylindrical open top cup having inwardly extending barb means formed about the upper inner surface thereof;

a cover of size and configuration for insertion into the open end of the vial and comprising an open bottom flexible cylindrical wall having outwardly extending hook means formed about the bottom outer surface thereof, the top surface of the cylindrical wall having an outwardly extending initially closed spout formed therein, the spout having an integral seal member thereacross closing said spout, said sealing member being joined to said spout by a reduced thickness region permitting removal of said sealing member to open said spout; the flexibility of said cylindrical wall permitting insertion of the hook means into said cup to engage said barb means and in combination with the relative rigidity of said cup and barb means providing secure locking engagement of said barb means with said hook means; and said container further comprising a flexible annulus joined integrally to and spaced laterally outwardly from the bottom of said cylindrical wall and having ribbed sealing means formed in the outer surface thereof of size for sealing against the inside of the cup.

* * * * *